US006318982B1

(12) United States Patent
Fujii et al.

(10) Patent No.: US 6,318,982 B1
(45) Date of Patent: Nov. 20, 2001

(54) SCROLL-TYPE COMPRESSOR

(75) Inventors: Toshiro Fujii; Naoya Yokomachi; Kazuo Murakami; Yoshiyuki Nakane, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/492,419

(22) Filed: Jan. 27, 2000

(30) Foreign Application Priority Data

Jan. 28, 1999 (JP) ..... 11-019586

(51) Int. Cl.[7] ..... F04C 18/00

(52) U.S. Cl. ..... 418/55.4; 418/55.5; 418/57; 418/55.2; 418/55.6; 418/55.1

(58) Field of Search ..... 418/183, 55.5, 418/57, 55.4

(56) References Cited

U.S. PATENT DOCUMENTS

| | | | | |
|---|---|---|---|---|
| 5,112,201 | | 5/1992 | Tamura et al. . | |
| 5,253,489 | * | 10/1993 | Yoshii | 418/55.6 |
| 5,591,018 | * | 1/1997 | Takeuchi et al. | 418/55.6 |
| 5,762,483 | | 6/1998 | Lifson et al. . | |
| 6,129,532 | * | 10/2000 | Kato et al. | 418/55.6 |
| 6,152,713 | * | 11/2000 | Hisanaga et al. | 418/55.2 |

FOREIGN PATENT DOCUMENTS

| | | | | |
|---|---|---|---|---|
| 4446350A1 | | 6/1995 | (DE) . | |
| 19620477A1 | | 11/1997 | (DE) . | |
| 19620480A1 | | 11/1997 | (DE) . | |
| 4-060188 | | 2/1992 | (JP) . | |
| 5-026002 | | 2/1993 | (JP) . | |
| 6-074164 | | 3/1994 | (JP) . | |
| 6-101663 | | 4/1994 | (JP) . | |
| 7-286587 | | 10/1995 | (JP) . | |
| JA-03-237203-A1 | * | 10/1991 | (JP) | 418/55.2 |
| 05-240174-A1 | * | 9/1993 | (JP) | 418/55.2 |
| JA-64-063687-A1 | * | 3/1989 | (JP) | 418/55.6 |
| JA-02-277991-A1 | * | 11/1990 | (JP) | 418/55.6 |
| JA-03-011181-A1 | * | 1/1991 | (JP) | 418/55.6 |
| JA-03-105091-A1 | * | 5/1991 | (JP) | 418/55.6 |
| 04-321788-A1 | * | 11/1992 | (JP) | 418/55.6 |
| 06-101663-A1 | * | 4/1994 | (JP) | 418/55.6 |
| 11-241682-A1 | * | 9/1999 | (JP) | 418/55.6 |

OTHER PUBLICATIONS

Patent Abstracts of Japan Publication No. 05296169, published Nov. 9, 1993.

Patent Abstracts of Japan Publication No. 11241691, published Sep. 7, 1999; and.

Patent Abstracts of Japan Publication No. 07286587, published Oct. 31, 1995.

* cited by examiner

*Primary Examiner*—Thomas Denion
*Assistant Examiner*—Theresa Trieu
(74) *Attorney, Agent, or Firm*—Morgan & Finnegan, L.L.P.

(57) ABSTRACT

A scroll-type compressor having a fixed scroll and a movable scroll. The fixed scroll includes a fixed base plate and a fixed volute wall extending from the fixed base plate. The movable scroll includes a movable base plate and a movable volute wall extending from the movable base plate. The movable volute wall has a distal end surface that faces the fixed base plate. A passage is formed through the movable volute wall and the movable base plate from the distal end surface. The passage reduces the area of the distal end surface of the movable volute wall, on which pressure is applied. This reduces the thrust load applied to the movable scroll and makes the compressor more reliable.

11 Claims, 8 Drawing Sheets

SCROLL-TYPE COMPRESSOR

BACKGROUND OF THE INVENTION

The present invention relates to a scroll-type compressor having a fixed scroll and a movable scroll.

A scroll-type compressor includes a fixed scroll and a movable scroll. The fixed scroll includes a fixed volute wall on its base plate. The movable scroll includes a movable volute wall on its base plate. Sealed spaces are formed between the fixed scroll and the movable scroll. The volumes of the sealed spaces vary in accordance with an orbital motion of the movable scroll.

The sealed spaces converge toward the inner ends of the volute walls of the fixed and movable scrolls. The compressed gas in the sealed spaces applies a force (thrust load) that separates the movable scroll from the fixed scroll. If the thrust load is too strong, the movable scroll is strongly pressed against a thrust bearing. This increases the force required to move the movable scroll, which applies excessive load to the mechanism that causes the movable scroll to orbit and lowers reliability of the mechanism.

In a scroll-type compressor described in Unexamined Japanese Patent Publication No. 6-74164, counter pressure is applied to the back of the movable scroll to oppose the thrust load, which prevents the movable scroll from being strongly pressed against the thrust bearing.

However, it is difficult to determine the level of the counter pressure. If the counter pressure is too strong, the distal end of the movable volute wall is strongly pressed against the base plate of the fixed scroll. This increases the force required to orbit the movable scroll and applies an excessive load to the orbiting mechanism.

SUMMARY OF THE INVENTION

An objective of the present invention is to improve reliability of scroll-type compressors.

To achieve the above objective, the present invention provides a scroll-type compressor structured as follows. A fixed scroll includes a fixed base plate and a fixed volute wall extending from the fixed base plate. A movable scroll includes a movable base plate and a movable volute wall extending from the movable base plate. The movable scroll cooperates with the fixed scroll to form a sealed space between them. The volume of the sealed space decreases as the movable scroll orbits around a predetermined axis. The movable volute wall has an end surface that faces the fixed base plate. A passage is formed in the movable volute wall. The passage has a first opening in the end surface and a second opening in the movable base plate.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A scroll-type compressor according to a first embodiment of the present invention will now be described with reference to FIGS. 1–4.

Figure 1:
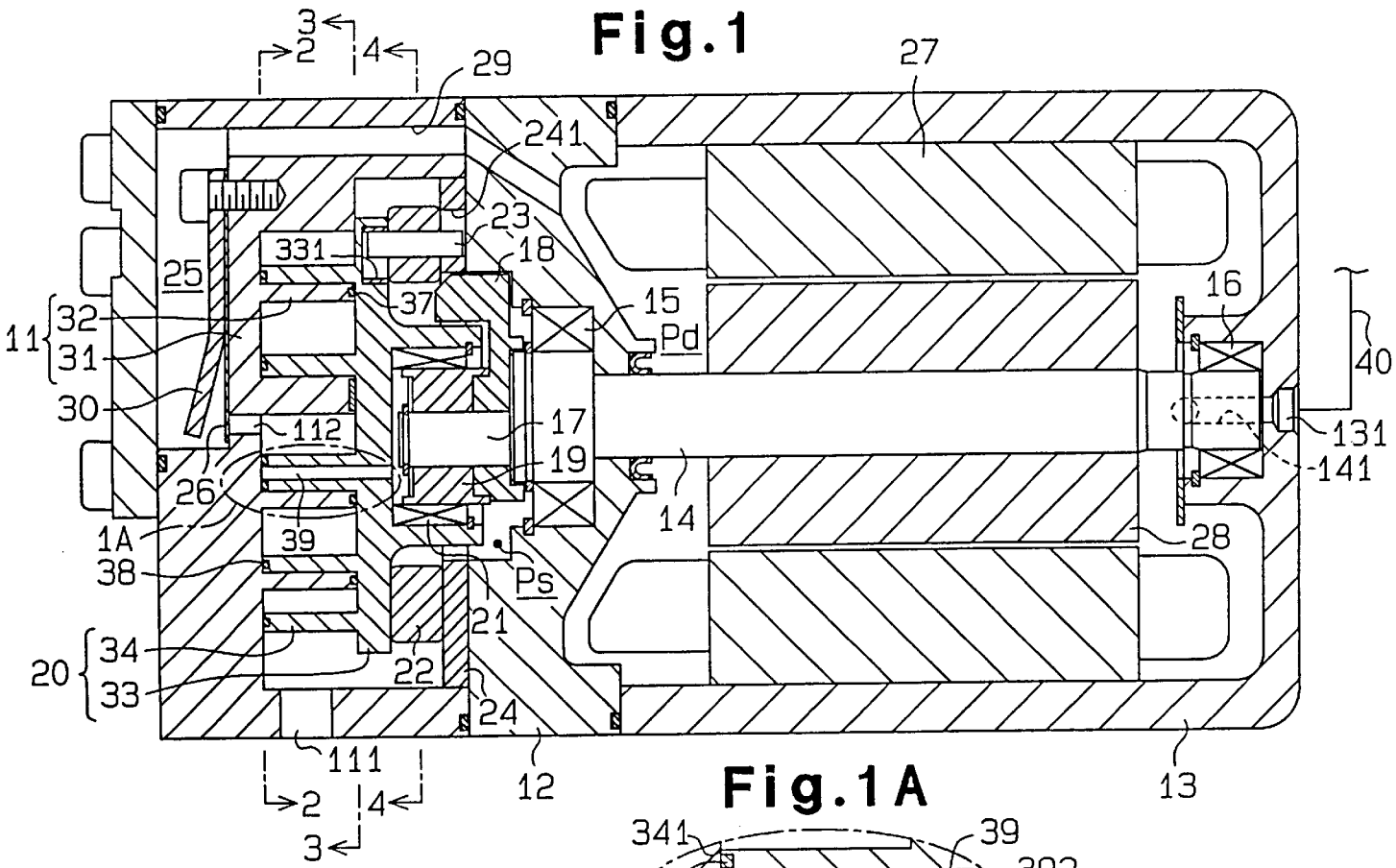
FIG. 1 is a cross-sectional view showing a compressor according to a first embodiment of the present invention.
Figure 1A:
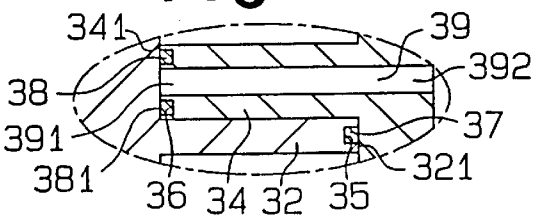
FIG. 1A is an enlargement of a portion of FIG. 1 as indicated.

As shown in FIG. 1, a fixed scroll 11 is coupled to a center housing 12, which is coupled to a motor housing 13. A drive shaft 14 is rotatably supported by the center housing 12 and the motor housing 13 through radial bearings 15, 16.

An eccentric shaft 17 is integrally formed with the drive shaft 14.

Figure 2:
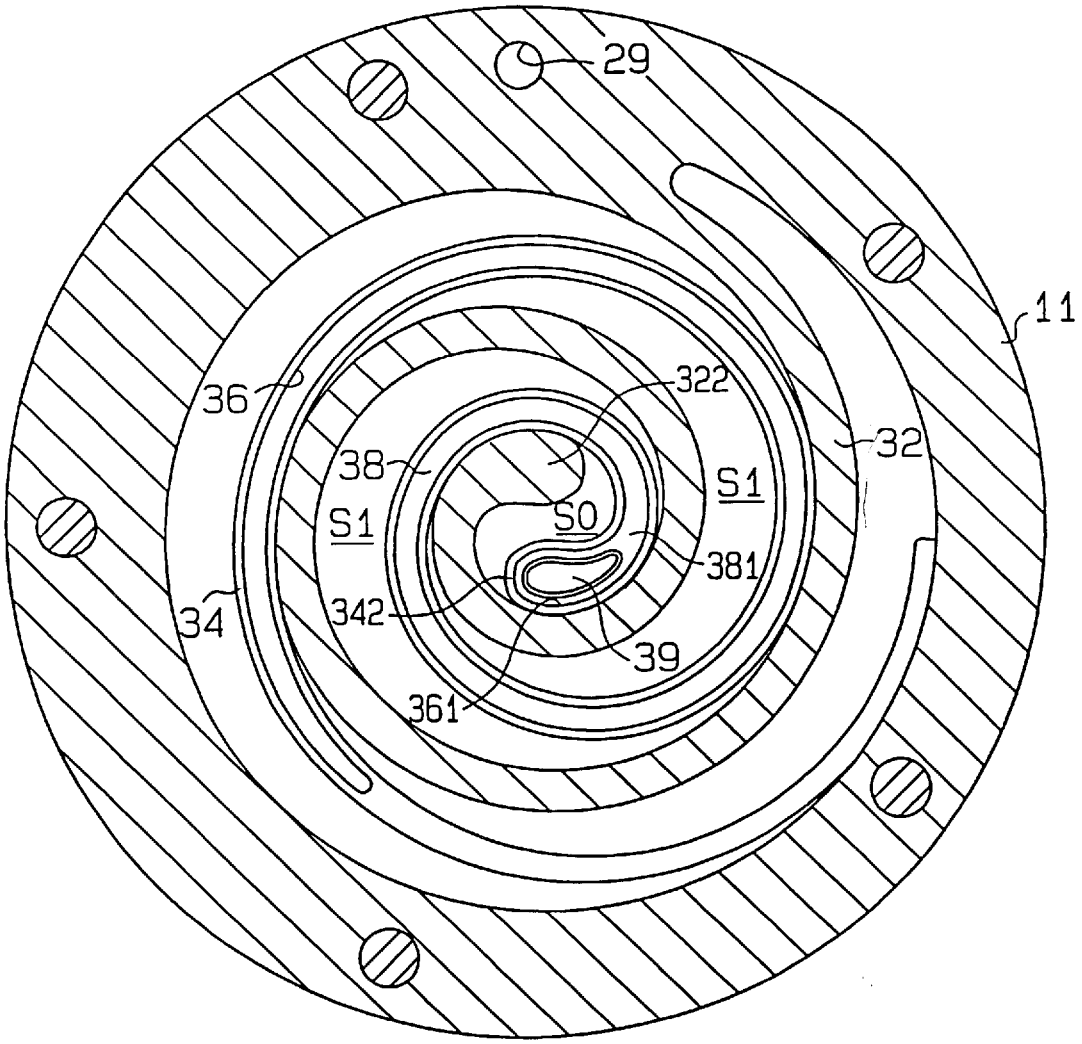
FIG. 2 is a cross-sectional view taken along the line 2—2 of FIG. 1.
Figure 3:
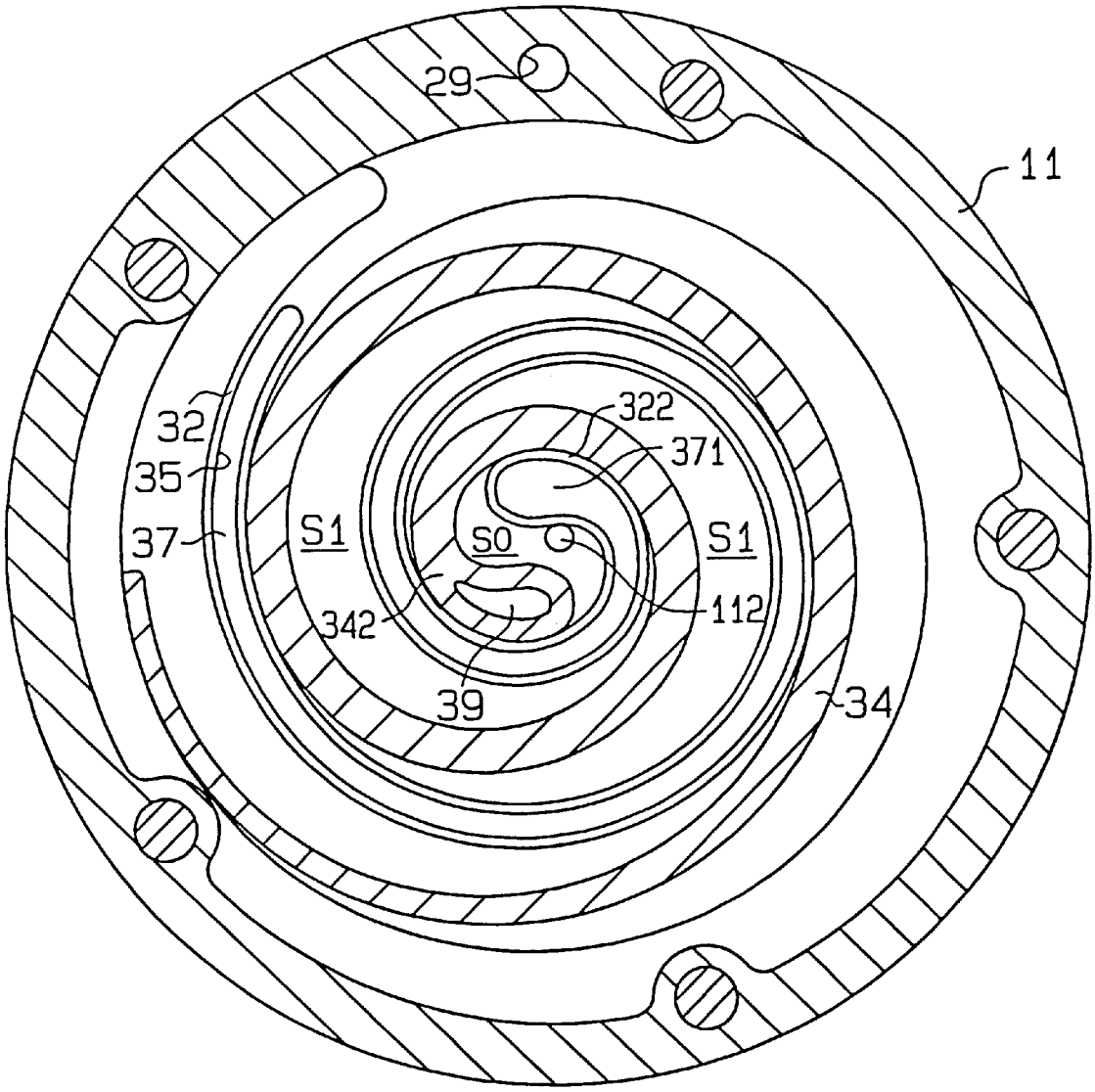
FIG. 3 is a cross-sectional view taken along the line 3—3 of FIG. 1.

The eccentric shaft 17 supports a balance weight 18 and a bushing 19. A movable scroll 20 is rotatably supported by the bushing 19 through a needle bearing 21 to face a fixed scroll 11. As shown in FIGS. 2 and 3, a fixed scroll base plate 31, a fixed volute wall 32, a movable scroll base plate 33, and a movable volute wall 34 form sealed spaces S0, S1. The movable scroll 20 orbits when the eccentric shaft 17 rotates. The balance weight 18 balances the centrifugal force generated by the orbiting motion of the movable scroll 20.

Figure 4:
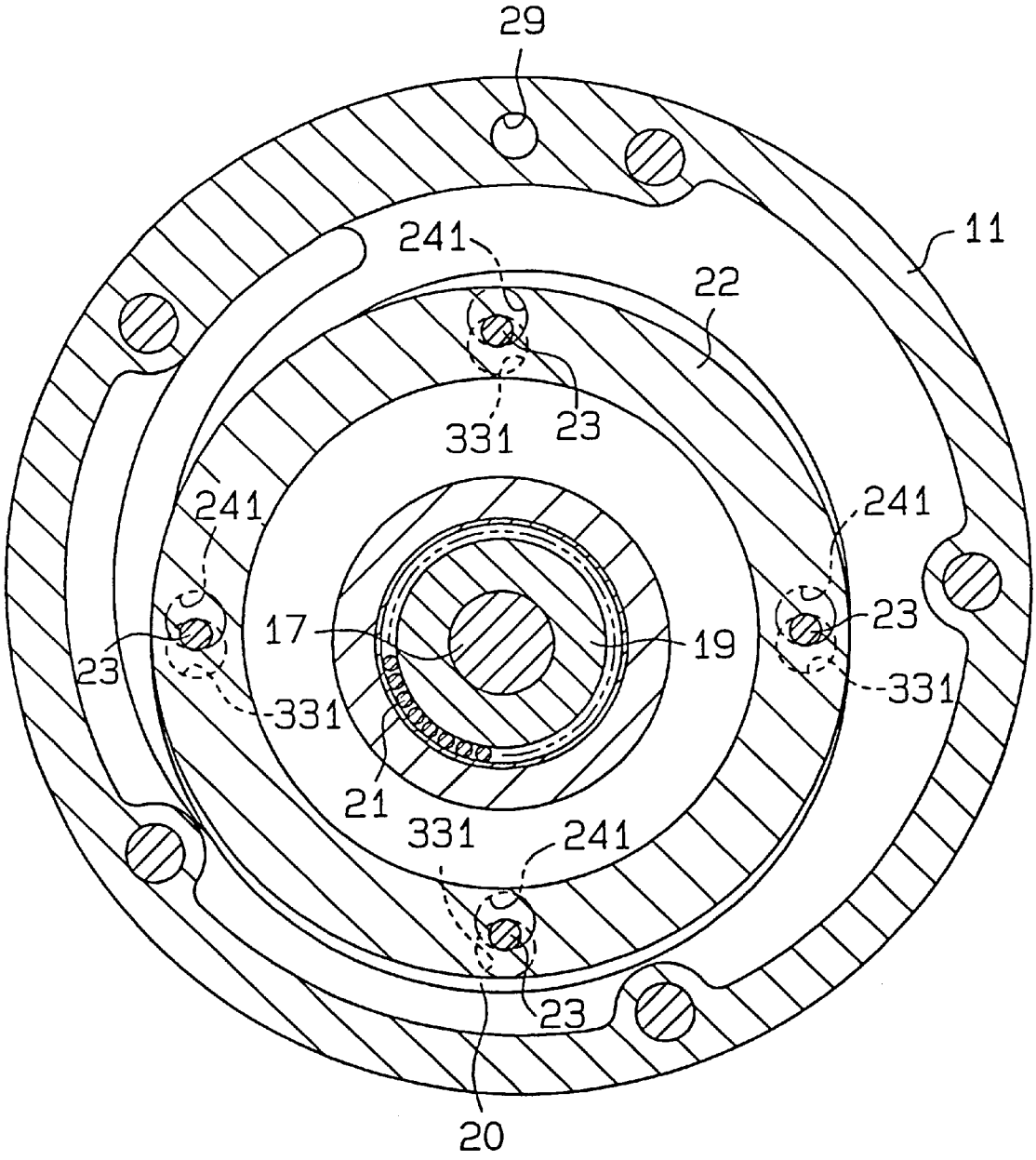
FIG. 4 is a cross-sectional view taken along the line 4—4 of FIG. 1.

An orbiting ring 22 is located between the movable base plate 33 and the center housing 12. Columnar pins 23 (four in the present embodiment), which prevent rotation of the orbiting ring 22, are secured to the orbiting ring 22. An annular bearing plate 24 is located between the center housing 12 and the orbiting ring 22. As shown in FIG. 4, holes 241 for the pins 23 are formed in the bearing plate 24. The number of the holes 241 is the same as the number of the pins 23. Holes 331, the number of which is the same as that of the pins 23, are formed in the movable base plate 33. The holes 241, 331 are equally spaced. The holes 241, 331 receive the pins 23.

A stator 27 is secured to the inner surface of the motor housing 13. A drive shaft 14 supports a rotor 28. When the stator 27 is supplied with electric current, the rotor 28 and the drive shaft 14 integrally rotate.

A central passage 39, or a hole, is formed in the inner end 342 of the movable volute wall 34 and passes through the movable volute wall 34 and the movable base plate 33. As shown in FIG. 1, the passage 39 has an opening 391 at the distal end surface 341 of the movable volute wall 34 and has an opening 392 at the back surface of the movable base plate 33. As shown in FIG. 2, the inner end 361 of the groove 36 is annular to surround the opening 391. The inner end 381 of the seal 38 has an annular portion, which fits in the inner end 361 and surrounds the opening 391.

As the eccentric shaft 17 rotates with the drive shaft 14, the movable scroll 20 orbits, which causes refrigerant gas to flow through an inlet 111 between the fixed base plate 31 and the movable base plate 33. One example of refrigerant that may be used is a carbon dioxide. As the movable scroll 20 orbits, peripheral sections of each pin 23 contact the walls of the holes 331, 241. The diameter of the holes 331, 241 is represented by D, the diameter of the pins 23 is represented by d, and the orbiting radius of the bushing 19 is represented by r. The relationship between them is determined by the following expression.

$$D=d+r$$

Accordingly, the orbiting radius of the movable scroll 20 is r, and the orbiting radius of the orbiting ring 22 is half the orbiting radius r of the movable scroll 20.

The orbiting ring 22 tends to rotate, but the contact by the pins 23 with the walls of the holes 241 prevents the orbiting ring 22 from rotating. The movable scroll 20 tends to rotate about the axis of the bushing 19, however the contact by the pins 23 with the walls of the holes 331 of the movable base plate 33 prevents the movable scroll 20 from rotating. That is, the movable scroll 20 and the orbiting ring 22 orbit without rotating.

The sealed spaces S1, S0 shown in FIGS. 2 and 3 converge toward the inner ends 322, 342 of the volute walls 32, 34 when the movable scroll 20 rotates. As the volumes of the sealed spaces S1, S0 are reduced, refrigerant gas is compressed and discharged to a discharge chamber 25 through a discharge port 112 in the fixed base plate 31 and a discharge valve 26. A retainer 30 limits the opening degree of the discharge valve 26. The compression reaction force of the sealed spaces S1, S0 is received by the bearing plate 24 through the orbiting ring 22.

As shown in FIG. 1, a discharge passage 29 connects the discharge chamber 25 to the interior of the motor housing 13. Refrigerant gas in the discharge chamber 25 flows into the motor housing 13 through the discharge passage 29. The interior of the motor housing 13 is a discharge pressure zone Pd, and the space between the movable scroll 20 and the center housing 12 is a suction pressure zone Ps. Refrigerant gas in the motor housing 13 flows to an external refrigerant circuit 40 through a passage 141 in the drive shaft 14 and an outlet 131 in the end wall of the motor housing 13.

Volute grooves 35, 36 are respectively formed in the end surfaces 321, 341 of the volute walls 32, 34. Volute seals 37, 38, which are made of synthetic resin, are fitted in the volute grooves 35, 36. The pressures in the sealed spaces S0, S1 are different. The difference of the pressures between the adjacent sealed spaces S0, S1 causes the seal 37 to be pressed against the movable base plate 33 and causes the seal 38 to be pressed against the fixed base plate 31. This helps to seal the sealed spaces S0, S1.

As shown in FIGS. 2 and 3, the internal end 322 of the fixed volute wall 32 is thicker than the remainder of the fixed volute wall 32. The inner end 342 of the movable volute wall 34 is thicker than the remainder of the movable volute wall 34. The shapes of the inner ends 322, 342 are determined to withstand a relatively high compression pressure.

A central passage 39, or a hole, is formed in the inner end 342 of the movable volute wall 34 and passes through the movable volute wall 34 and the movable base plate 33. As shown in FIG. 1, the passage 39 has an opening 391 at the distal end surface 341 of the movable volute wall 34 and has an opening 392 at the back surface of the movable base plate 33. As shown in FIG. 2, the seal 38 fits in the groove 36 and surrounds the opening 391.

The first embodiment has the following advantages.

The compressed gas between the movable scroll 20 and the fixed scroll 11 applies a thrust load to the movable scroll 20 to separate the movable scroll 20 from the fixed scroll 11. The compressed gas also applies force to the distal end surface 341 of the movable volute wall 34. The force applied to the distal end surface 341 contributes to the thrust load. The opening 391 of the passage 39 passes through the movable volute wall 34 and the movable base plate 33 and reduces the area to which the pressure of the compressed gas is applied at the distal end surface 341. Accordingly, the passage 39 reduces the thrust load caused by the gas pressure applied to the movable scroll 20. This reduces the load applied to the bushing 19 and the needle bearing 21, which form the orbiting mechanism. As a result, the orbiting mechanism and the compressor are more reliable.

Since the passage 39 is connected to the suction pressure zone Ps through the movable base plate 33, the efficiency of compression will be reduced if compressed gas in the sealed space S0 flows to the passage 39. However, the volute seal 38 surrounds the opening 391 of the passage 39 and limits the flow of compressed gas from the sealed space S0 to the passage 39.

The pressure of the compressed gas between the fixed scroll 11 and the movable scroll 20 increases toward the inner ends 322, 342 of the scrolls 11, 20. That is, the gas pressure applied to the distal end surface 341 of the movable volute wall 34 increases toward the inner end 342. The opening 391 of the passage 39 is located in the inner end 342, which receives the highest pressure. Therefore, the thrust load is efficiently reduced.

The inner end 342 of the movable volute wall 34 is thicker than the remainder of the movable volute wall 34. The thicker the inner end 342 is, the greater the area of the distal end surface 341 is. The greater the area of the distal end surface 341 is, the greater the thrust load applied to the movable scroll 20 is. Accordingly, reducing the pressure receiving area in the distal end surface 341 of the inner end 342 reduces the thrust load applied to the movable scroll 20. Since the opening 391 of the passage 39 is located in the distal end surface 341 of the inner end 342, the pressure receiving area is efficiently reduced, which reduces the thrust load.

Carbon dioxide, which serves as the refrigerant in the refrigeration circuit, is normally more highly pressurized than chlorofluorocarbon. In using such a high-pressure refrigerant, suppressing the thrust load is especially important. The passage 39 is especially effective when employed in a scroll-type compressor using high-pressure gas.

Figure 5:
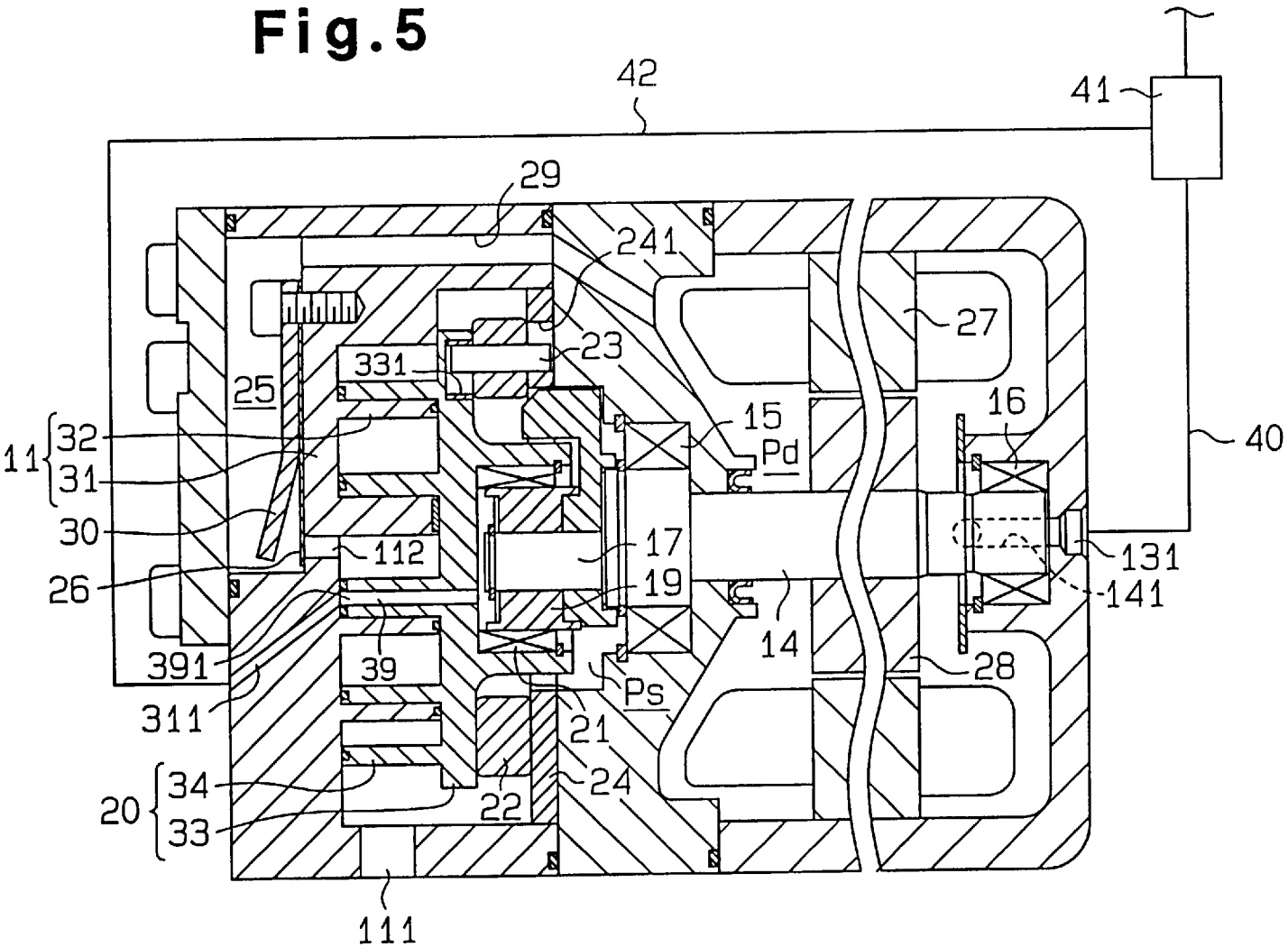
FIG. 5 is a partial cross-sectional view showing a second embodiment.

A second embodiment will now be described with reference to FIG. 5. Members of the second embodiment that are similar to those of the first embodiment have the same reference numbers.

In the second embodiment, an oil separator 41 is located in the external refrigerant circuit 40. The oil separator 41 separates oil from the refrigerant. An oil passage 311 is located in the fixed base plate 31 of the fixed scroll 11. The oil passage 311 is open at the front surface of the fixed base plate 31 and is continuously opposed to the opening 391 of the passage 39 of the movable scroll 20. Oil separated by the oil separator 41 is sent to the oil passage 311 through a tube 42 by the discharge pressure. Oil in the oil passage 311 flows to suction pressure zone Ps through the passage 39. Oil in the suction pressure zone Ps flows to the discharge pressure zone Pd with refrigerant gas via the sealed spaces S1, S0. This lubricates the parts that require lubrication. Using the passage 39 as part of an oil supply route simplifies the structure.

Figure 6:
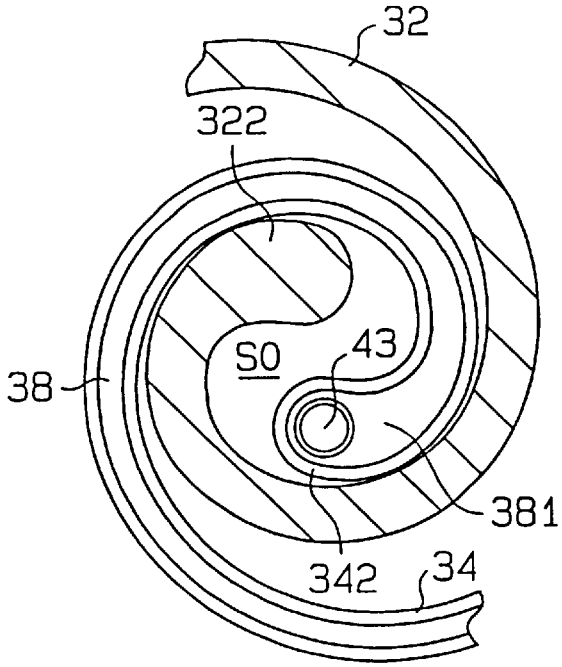
FIG. 6 is a partial cross-sectional view showing a third embodiment.

A third embodiment will now be described with reference to FIG. 6. Members of the third embodiment that are similar to those of the first embodiment have the same reference numbers.

In the third embodiment, a central passage 43 for reducing pressurized area has a circular cross section. The circular central passage 43 is preferred for strengthening the inner end 342. Also, the circular central passage 43 is easily formed.

Figure 7:
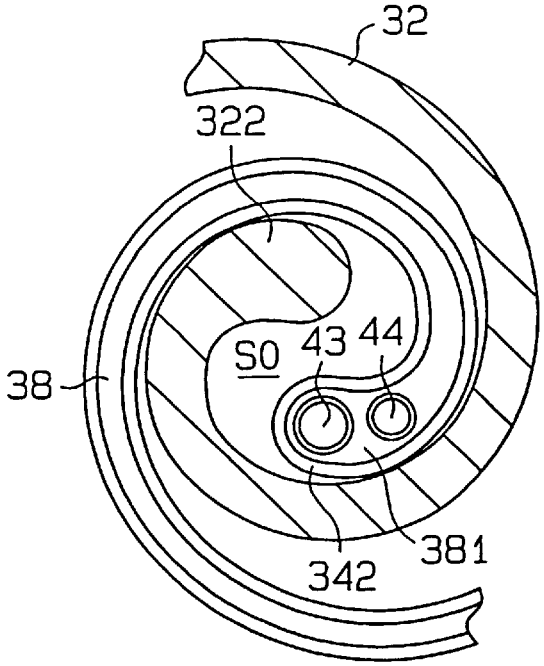
FIG. 7 is a partial cross-sectional view showing a fourth embodiment.

A fourth embodiment will now be described with reference to FIG. 7. Members of the fourth embodiment that are similar to those of the third embodiment have the same reference numbers.

In the fourth embodiment, there are two circular central passages 43, 44. The central passages 43, 44 efficiently reduce the pressurized area in the distal end surface 341 without weakening the inner end 342.

Figure 8:
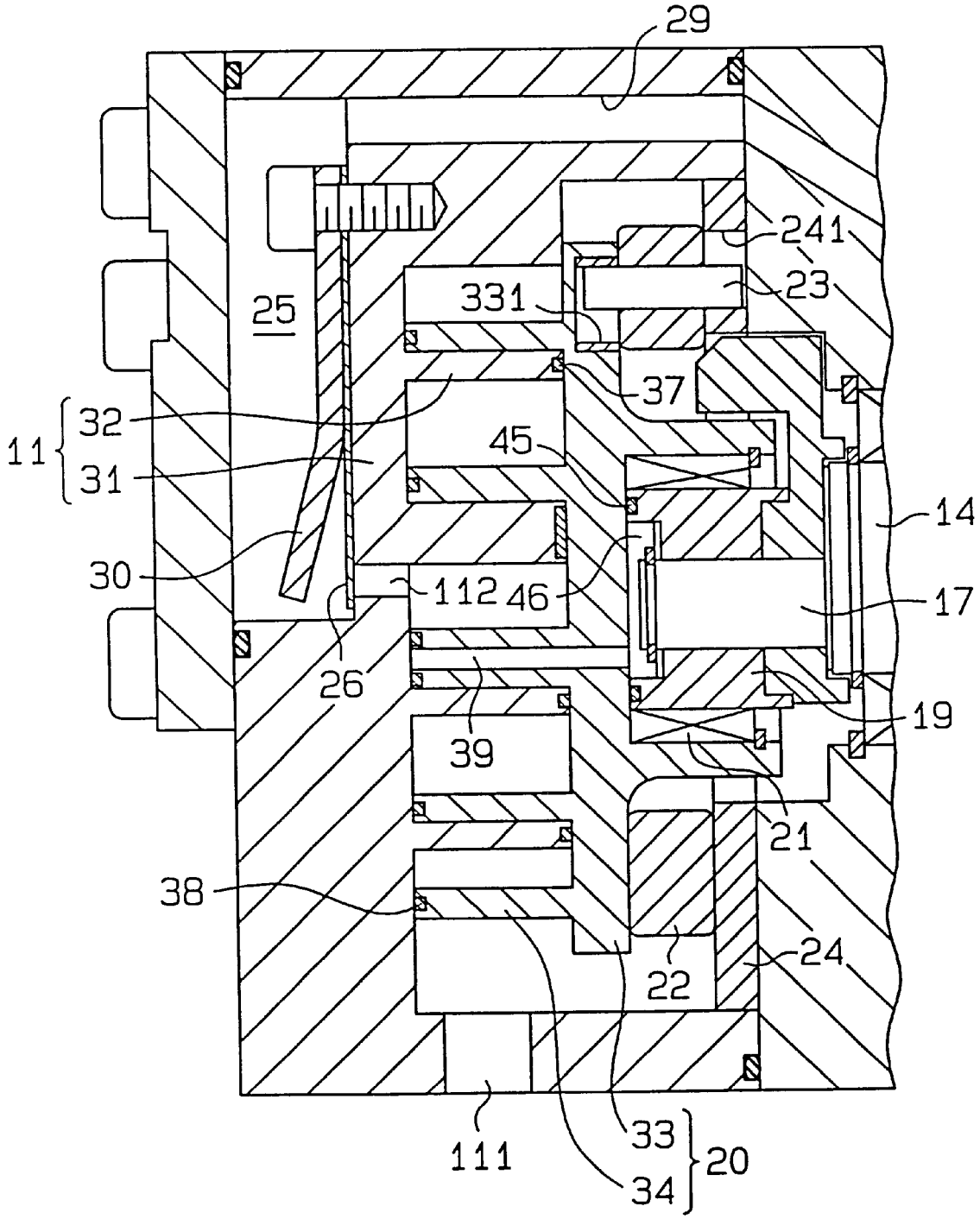
FIG. 8 is a partial cross-sectional view showing a fifth embodiment.

A fifth embodiment will now be described with reference to FIG. 8. Members of the fifth embodiment that are similar to those of the first embodiment have the same reference numbers.

In the fifth embodiment, a seal ring 45 is located between the movable base plate 33 and the bushing 19. A back pressure chamber 46 is defined between the bushing 19 and the movable plate 33. The passage 39 is connected to the back pressure chamber 46, which makes the pressure in the back pressure chamber 46 substantially equal to that in the sealed space S0. The pressure in the back pressure chamber 46 works against the thrust load applied to the movable scroll 20, which reduces the load applied to the orbiting mechanism.

Figure 9:
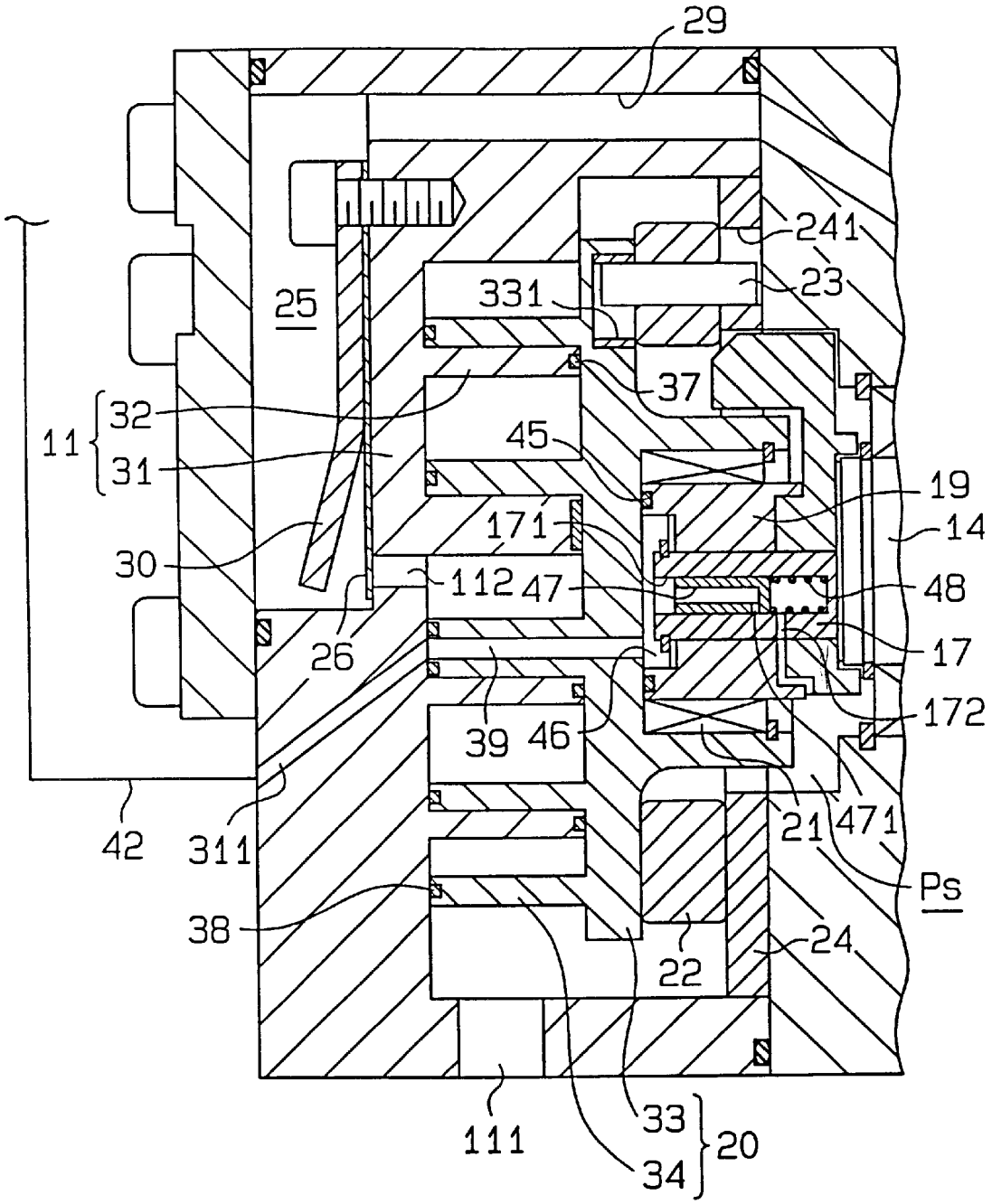
FIG. 9 is a partial cross-sectional view showing a sixth embodiment.

A sixth embodiment will now be described with reference to FIG. 9. Members of the sixth embodiment that are similar to those of the fifth embodiment have the same reference numbers.

In the sixth embodiment, a pressure receiving hole 171 is formed in the end surface of the eccentric shaft 17. A pressure receiving tube 47, or a shutter, is accommodated in the pressure receiving hole 171 and is permitted to slide. A spring 48 is located in the hole 171 and urges the tube 47 toward the back pressure chamber 46. The hole 171 is connected to the suction pressure zone Ps through a passage 172. An aperture 471 is formed in the tube 47. When the aperture 471 is connected to the passage 172, the back pressure chamber 46 is connected to the suction pressure zone Ps. When the pressure in the back pressure chamber 46 reaches a predetermined level, the spring 48 contracts, which causes the aperture 471 to connect with the passage 172, which maintains the pressure in the back pressure chamber near the predetermined level. The characteristics of the spring 48 are chosen to achieve the desired results. During the operation of the compressor, the aperture 471 is always connected to the passage 172. Oil that is supplied to the passage 39 from the oil passage 311 flows to the suction pressure zone Ps through the back pressure chamber 46, the pressure receiving hole 171, the aperture 171, and the passage 172.

The sixth embodiment has the same advantages of the second and fifth embodiments.

The present invention can further be embodied as follows.

The inner end of the movable volute wall may have the same thickness as the remainder of the movable volute wall.

The opening of the central passage area may be formed in a distal end surface of a part of the movable scroll other than its inner end.

More than three passages for reducing pressurized area may be formed.

The central passage may be formed such that its diameter increases from the distal surface 341 toward the movable base plate 33 of the movable volute wall 34.

The passage for reducing pressurized area may be inclined with respect to the axis of the drive shaft.

The present examples and embodiments are to be considered as illustrative and not restrictive and the invention is not to be limited to the details given herein, but may be modified within the scope and equivalence of the appended claims.

What is claimed is:

1. A scroll-type compressor comprising:

a fixed scroll, which includes a fixed base plate and a fixed volute wall extending from the fixed base plate;

a movable scroll, which includes a movable base plate and a movable volute wall extending from the movable base plate, wherein the movable scroll cooperates with the fixed scroll to form a sealed space between them, wherein the volume of the sealed space decreases as the movable scroll orbits around a predetermined axis, the movable volute wall having an end surface that faces the fixed base plate;

a passage formed in the movable volute wall, wherein the passage has a first opening in the end surface and a second opening in the movable base plate; and a seal attached to the end surface of the movable volute wall, wherein the seal surrounds the first opening.

2. The scroll-type compressor according to claim 1, wherein the movable volute wall has an inner end near the axis of the movable scroll, wherein the passage is located in the inner end.

3. The scroll-type compressor according to claim 2, wherein the thickness of the inner end is greater than that of the remainder of the movable volute wall.

4. The scroll-type compressor according to claim 1 further including a suction pressure zone, which is filled with gas that is to be supplied to the sealed space, wherein the passage is connected to the suction pressure zone, wherein the fixed scroll has an oil supply route, which is connected to the first opening of the passage.

5. The scroll-type compressor according to claim 1, wherein the movable base plate includes a front surface on which the movable volute wall is formed and a back surface, which is opposite to the front surface, wherein the back surface defines part of a back pressure chamber, wherein the passage is connected to the back pressure chamber by the second opening.

6. The scroll-type compressor according to claim 5 further including:

an oil supply route, which is located in the fixed scroll such that the route is connected to the first opening of the passage;

a suction pressure zone, which is filled with gas that is to be supplied to the sealed space; and a shutter, which selectively connects or disconnects the back pressure chamber with the suction pressure zone, wherein, when the pressure in the back pressure chamber reaches a predetermined value, the shutter connects the back pressure chamber to the suction pressure zone.

7. The scroll-type compressor according to claim 1, wherein the cross-sectional shape of the passage is circular.

8. The scroll-type compressor according to claim 1, wherein carbon dioxide is compressed in the sealed space.

9. A scroll-type compressor comprising:

a fixed scroll, which includes a fixed base plate and a fixed volute wall extending from the fixed base plate;

a movable scroll, which includes a movable base plate and a movable volute wall extending from the movable base plate, wherein the movable scroll cooperates with the fixed scroll to form a sealed space between them, wherein the volume of the sealed space decreases as the movable scroll orbits around a predetermined axis, the movable volute wall having an end surface that faces the fixed base plate, wherein a hole passes through the movable volute wall and the movable base plate from the end surface to reduce the area of the end surface on which pressure is applied, wherein the hole has an opening in the end surface; and a seal attached to the end surface of the movable volute wall, wherein the seal surrounds the opening.

10. A scroll-type compressor comprising:

a fixed scroll, which includes a fixed base plate and a fixed volute wall extending from the fixed base plate;

a movable scroll, which includes a movable base plate and a movable volute wall extending from the movable base plate, wherein the movable scroll cooperates with the fixed scroll to form a sealed space between them, wherein the volume of the sealed space decreases as the movable scroll orbits around a predetermined axis, the movable volute wall having an end surface that faces the fixed base plate and an inner end near the axis of the movable scroll, wherein the thickness of the inner end is greater than that of the remainder of the movable volute wall; and a passage formed in the inner end of the movable volute wall, wherein the passage has a first opening in the end surface and a second opening in the movable base plate.

11. A scroll-type compressor comprising:

a fixed scroll, which includes a fixed base plate and a fixed volute wall extending from the fixed base plate;

a movable scroll, which includes a movable base plate and a movable volute wall extending from the movable base plate, wherein the movable scroll cooperates with the fixed scroll to form a sealed space between them, wherein the volume of the sealed space decreases as the movable scroll orbits around a predetermined axis, the movable volute wall having an end surface that faces the fixed base plate;

a passage formed in the movable volute wall, wherein the passage has a first opening in the end surface and a second opening in the movable base plate; and a suction pressure zone, which is filled with gas that is to be supplied to the sealed space, wherein the passage is connected to the suction pressure zone, wherein the fixed scroll has an oil supply route, which is connected to the first opening of the passage.

* * * * *

UNITED STATES PATENT AND TRADEMARK OFFICE

CERTIFICATE OF CORRECTION

PATENT NO. : 6,318,982 B1
DATED : November 20, 2001
INVENTOR(S) : Toshiro Fujii et al.

It is certified that error appears in the above-identified patent and that said Letters Patent is hereby corrected as shown below:

Column 2,
Lines 26-27, there should not be a separate paragraph please change:
"radial bearings 15, 16.
An eccentric shaft 17" to -- radial bearings 15, 16. An eccentric shaft 17 --;
Please delete the entire whole paragraph from lines 55 to 64.

Column 3,
Line 63, please delete "the seal 38 fits in the groove 36 and surrounds the opening 39." after FIG. 2, and insert therefor -- the inner end 361 of the groove 36 is annular to surround the opening 391. The inner end 381 of the seal 38 has an annular portion, which fits in the inner end 361 and surrounds the opening 391. --

Signed and Sealed this

Eighteenth Day of June, 2002

*Attest:*

*Attesting Officer*

JAMES E. ROGAN
*Director of the United States Patent and Trademark Office*